US007316724B2

(12) United States Patent
Bangaru et al.

(10) Patent No.: US 7,316,724 B2
(45) **Date of Patent: *Jan. 8, 2008**

(54) MULTI-SCALE CERMETS FOR HIGH TEMPERATURE EROSION-CORROSION SERVICE

(75) Inventors: Narasimha-Rao Venkata Bangaru, Annandale, NJ (US); Jayoung Koo, Bridgewater, NJ (US); ChangMin Chun, Belle Mead, NJ (US); Hyun-Woo Jin, Phillipsburg, NJ (US); John Roger Peterson, Ashburn, VA (US); Robert Lee Antram, Warrenton, VA (US); Christopher John Fowler, Springfield, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 141 days.

This patent is subject to a terminal disclaimer.

(21) Appl. No.: 10/829,819

(22) Filed: Apr. 22, 2004

(65) Prior Publication Data

US 2007/0131054 A1 Jun. 14, 2007

Related U.S. Application Data

(60) Provisional application No. 60/471,995, filed on May 20, 2003.

(51) Int. Cl.

| | |
|---|---|
| ***C22C 29/02*** | (2006.01) |
| ***C22C 29/12*** | (2006.01) |
| ***C22C 29/14*** | (2006.01) |
| ***C22C 29/16*** | (2006.01) |

(52) U.S. Cl. ..... 75/232; 75/235; 75/236; 75/238

(58) Field of Classification Search ..... 75/235, 75/236, 238, 244, 232

See application file for complete search history.

(56) References Cited

U.S. PATENT DOCUMENTS

| | | | | | |
|---|---|---|---|---|---|
| 3,493,351 | A | * | 2/1970 | Daniels et al. | 75/233 |
| 3,705,791 | A | * | 12/1972 | Bredzs | 428/565 |
| 3,864,093 | A | * | 2/1975 | Wolfla | 428/564 |
| 4,101,713 | A | * | 7/1978 | Hirsch et al. | 428/554 |
| 4,124,737 | A | * | 11/1978 | Wolfla et al. | 428/640 |
| 4,156,053 | A | * | 5/1979 | Baranow | 428/570 |
| 4,475,983 | A | | 10/1984 | Bader et al. | 156/656 |
| 4,479,743 | A | * | 10/1984 | Stahl | 406/193 |
| 4,505,746 | A | | 3/1985 | Nakai et al. | 75/243 |
| 4,615,913 | A | | 10/1986 | Jones et al. | 427/226 |
| 4,734,339 | A | | 3/1988 | Schachner et al. | 428/701 |
| 4,806,161 | A | | 2/1989 | Fabiny et al. | 106/14.12 |
| 4,808,055 | A | | 2/1989 | Wertz et al. | 416/224 |
| 5,302,181 | A | * | 4/1994 | Morichika et al. | 75/245 |
| 5,439,499 | A | | 8/1995 | Pastor et al. | 75/232 |
| 5,449,536 | A | * | 9/1995 | Funkhouser et al. | 427/597 |
| 5,470,372 | A | | 11/1995 | Weinl | 75/238 |
| 6,022,508 | A | | 2/2000 | Berns | 419/6 |

FOREIGN PATENT DOCUMENTS

| | | |
|---|---|---|
| DE | 10117657 A1 | 4/2001 |
| EP | 0376878 | 12/1989 |
| WO | WO03010350 A1 | 2/2003 |

* cited by examiner

*Primary Examiner*—Roy King
*Assistant Examiner*—Ngoclan T. Mai
(74) *Attorney, Agent, or Firm*—Ramesh Varadaraj; Robert A. Migliorini

(57) ABSTRACT

A cermet composition represented by the formula (PQ)(RS)X comprising: a ceramic phase (PQ), a binder phase (RS) and X wherein X is at least one member selected from the group consisting of an oxide dispersoid E, an intermetallic compound F and a derivative compound G wherein said ceramic phase (PQ) is dispersed in the binder phase (RS) as particles of diameter in the range of about 0.5 to 3000 microns, and said X is dispersed in the binder phase (RS) as particles in the size range of about 1 nm to 400 nm.

26 Claims, 4 Drawing Sheets

MULTI-SCALE CERMETS FOR HIGH TEMPERATURE EROSION-CORROSION SERVICE

This application claims the benefit of U.S. Provisional application 60/471,995 filed May 20, 2003.

FIELD OF INVENTION

The present invention is broadly concerned with cermets, particularly multi-scale cermet compositions and process for preparing same. These cermets are suitable for high temperature applications wherein materials with superior erosion and corrosion resistance are required.

BACKGROUND OF INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are currently used for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials is chemically bonded castable alumina refractories. These castable alumina refractories are applied to the surfaces in need of protection and upon heat curing hardens and adheres to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Therefore there is a need for materials with superior erosion and corrosion resistance properties for high temperature applications. The cermet compositions of the instant invention satisfy this need.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

The present invention deals with multi-scale cermet compositions comprising a ceramic phase and a dispersion strengthened binder phase suitable for use in high temperature applications. In addition to superior corrosion resistance, strength and toughness of dispersion strengthened binder phase are some of the materials parameters imparting enhanced erosion resistance to the cermet at high temperatures in chemical and petroleum processing operations or other operations requiring erosion resistance at elevated temperatures.

The present invention includes new and improved cermet compositions.

The present invention also includes cermet compositions suitable for use at high temperatures.

Additionally, the present invention includes an improved method for protecting metal surfaces against erosion and corrosion under high temperature conditions.

These and other objects will become apparent from the detailed description which follows.

SUMMARY OF INVENTION

The invention includes a cermet composition represented by the formula (PQ)(RS)X comprising: a ceramic phase (PQ), a binder phase (RS) and X wherein X is at least one member selected from the group consisting of an oxide dispersoid E, an intermetallic compound F and a derivative compound G wherein said ceramic phase (PQ) is dispersed in the binder phase (RS) as particles of diameter in the range of about 0.5 to 3000 microns, and said X is dispersed in the binder phase (RS) as particles in the size range of about 1 nm to 400 nm.

DETAILED DESCRIPTION OF THE INVENTION

Figure 1:
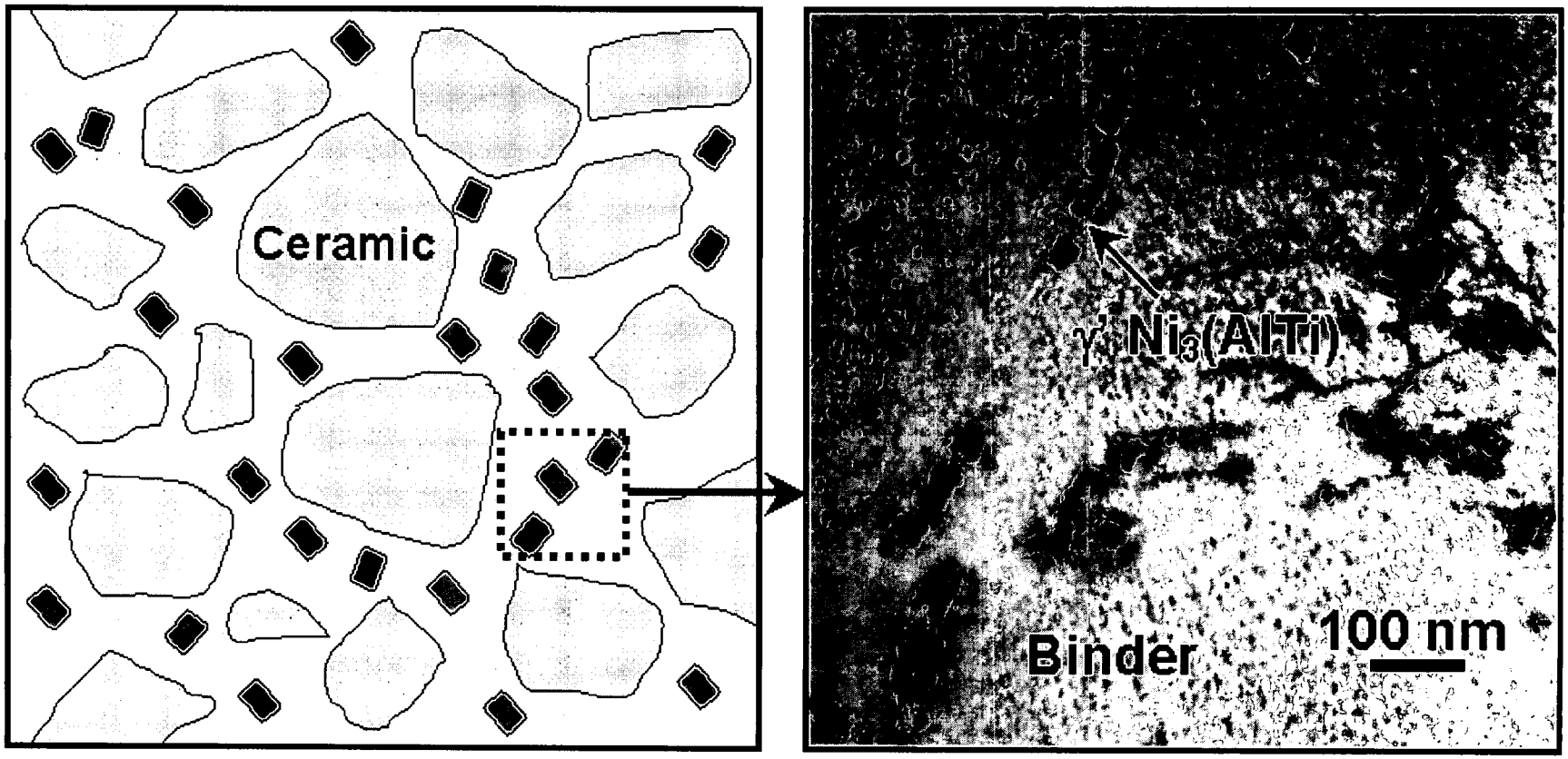
FIG. 1 is a schematic illustration of multi-scale cermet made using γ' $Ni_3(AlTi)$ strengthened binder phase (Ni (balance):15Cr:3Al:1Ti) and a transmission electron microscopy (TEM) image of binder phase illustrating reprecipitation of cuboidal γ' $Ni_3(AlTi)$.

Erosion processes occur through a combination of mechanical deformation and degradation processes. For ductile metals and alloys such as the binder phase in cermet, the material loss at the surface is mostly associated with sequential extrusion, forging and fracture. Materials loss by erosion (E) can be analytically described by the following equation.

$$E \propto \frac{\rho_p \cdot v_p^2}{P_t} \cdot f(\alpha)$$

where $v_p$ is velocity of impinging erodants, $r_p$ is density of impinging erodants, $P_t$ is plastic flow stress of target and α is impact angle respectively.

Applicants believe that the erosion process in cermets is controlled by ceramic skeleton initially and by the strength and toughness of the metallic binder subsequently. Consequently, in the instant invention applicants conceive a method to enhance erosion performance of cermets by increasing the flow strength of metallic binder phase while maintaining substantially the fracture toughness. One way to increase flow stress of materials is through a fine dispersion of a reinforcing phase within the metallic binder phase. This is the concept of multi-scale cermets of the instant invention.

One component of the multi-scale cermet composition represented by the formula (PQ)(RS)X is the ceramic phase denoted as (PQ). In the ceramic phase (PQ), P is a metal selected from the group consisting of Al, Si, Mg, Group IV, Group V, Group VI elements of the Long Form of The Periodic Table of Elements and mixtures thereof. Q is selected from the group consisting of carbide, nitride, boride, carbonitride, oxide and mixtures thereof. Thus the ceramic phase (PQ) in the multi-scale cermet composition is a metal carbide, nitride, boride, carbonitride or oxide. The molar ratio of P:Q in (PQ) can vary in the range of 0.5:1 to 30:1. As illustrative examples, when P=Cr, Q is a carbide then (PQ) can be $Cr_{23}C_6$ wherein P:Q is about 4:1. When P=Cr, Q is a carbide then (PQ) can be $Cr_7C_3$ wherein P:Q is about 2:1. The ceramic phase imparts hardness to the multi-scale cermet and erosion resistance at temperatures up to about 1500° C. In the multi-scale cermet composition (PQ) ranges from about 30 to 95 vol %, preferably 50 to 95 vol %, and even more preferably 70 to 90 vol %, based on the volume of the multi-scale cermet.

Another component of the multi-scale cermet composition represented by the formula (PQ)(RS)X is the binder phase denoted as (RS). In the binder phase (RS), R is the base metal selected from the group consisting of Fe, Ni, Co, Mn and mixtures thereof. S is the alloying member selected from Si, Cr, Ti, Al, Nb, Mo and mixtures thereof. Further, the binder phase is the continuous phase of the multi-scale composition and the ceramic phase (PQ) is dispersed in the binder phase (RS) as particles in the size range of about 0.5 to 3000 microns. Preferably between about 1 to 2000 microns. More preferably between about 1 to 1000 microns. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes. In the multi-scale cermet composition (RS) is in the range of 4.5 to 70 vol % based on the volume of the multi-scale cermet. The base metal R to alloying metal S mass ratio ranges from 50/50 to 90/10. In one preferred embodiment the chromium content in the binder phase (RS) is at least 12 wt % based on the total weight of the binder phase (RS).

Yet another component of the multi-scale cermet composition represented by the formula (PQ)(RS)X, where X is the oxide dispersoid phase denoted as E. The oxide dispersoid phase comprises oxides selected from the group of oxides of Al, Ti, Nb, Zr, Hf, V, Ta, Cr, Mo, W, Fe, Mn, Ni, Si, Y and mixtures thereof. One feature of the oxide dispersoid is that the oxide dispersoids E are dispersed in the substantial continuous binder phase (RS) as particles having a diameter between about 1 nm and about 400 nm, preferably between about 1 nm and about 200 nm and more preferably between about 1 nm and about 100 nm. In a preferred embodiment the oxide dispersoid can be added to the binder phase. In another embodiment they can be formed in-situ during the preparation process. In yet another embodiment they can be formed during use. When the oxide is formed in-situ the oxide forming elements are added to the binder phase prior to the sintering process. The oxide forming elements are Al, Ti, Nb, Zr, Hf, V, Ta, Cr, Mo, W, Fe, Mn, Ni, Si, Y and mixtures thereof. In the multi-scale cermet composition, E ranges from of about 0.1 to 10 vol % based on the volume of the multi-scale cermet.

Yet another component of the multi-scale cermet represented by the formula (PQ)(RS)X, where X is the intermetallic compound F is selected from the group consisting of gamma prime (γ') and beta (β) such as $Ni_3Al$, $Ni_3Ti$, $Ni_3Nb$, NiAl, $Ni_2AlTi$, NiTi, $Ni_2AlSi$, FeAl, $Fe_3Al$, CoAl, $Co_3Al$, $Ti_3Al$, $Al_3Ti$, TiAl, $Ti_2AlNb$, $TiAl_2Mn$, $TaAl_3$, $NbAl_3$ and mixtures thereof. Intermetallic compounds F can be formed from the binder phase (RS) during sintering of the cermet or from a special processing such as an intermediate temperature hold during the cooling from the sintering temperature to the ambient. Furthermore, the intermetallic compound particles can be added as powder to the binder powder and mixed as the initial powder for producing the cermet. The inter-metallic particles may also form during service in-situ or be induced by a suitable post-sintering heat treatment. One feature of the intermetallic compound F is that they are dispersed in the continuous binder phase (RS) as particles having a diameter between about 1 nm and about 400 nm, preferably between about 1 nm and about 200 nm and more preferably between about 1 nm and about 100 nm. The intermetallic compound F ranges from of about 0.1 to 10 vol % based on the volume of the multi-scale cermet.

Figure 2:
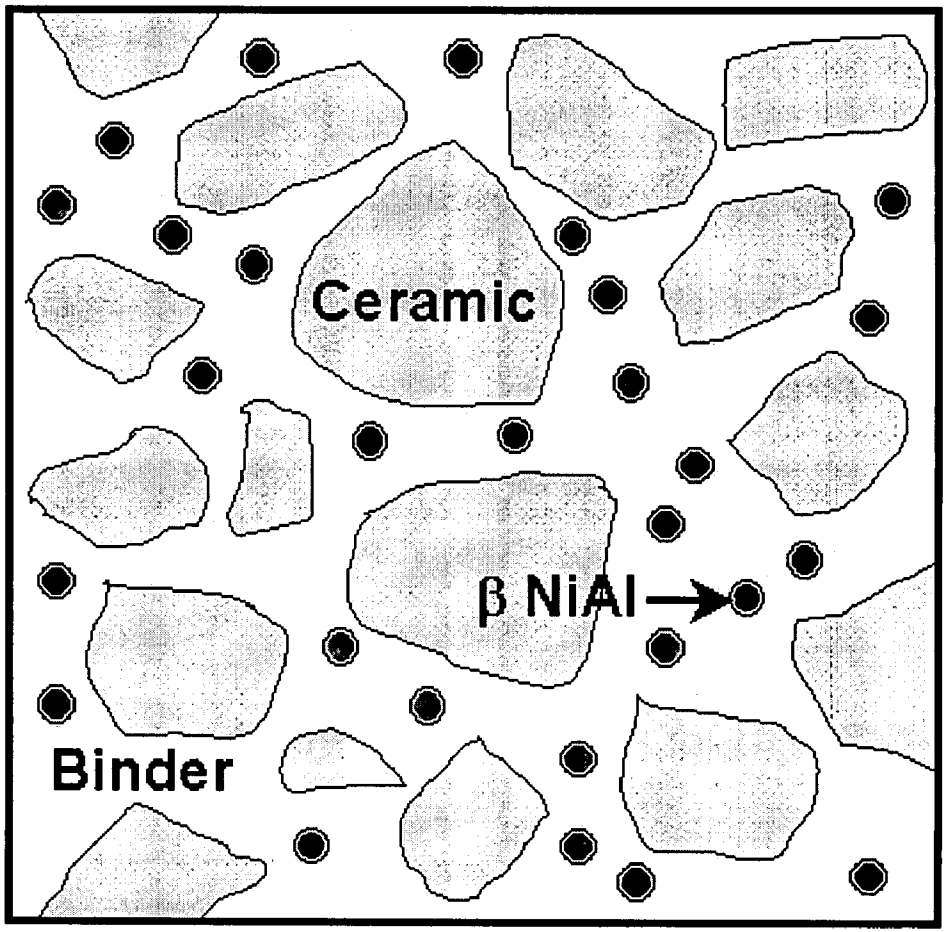
FIG. 2 is a schematic illustration of multi-scale cermet made using β NiAl strengthened binder phase (Fe(balance): 18Cr:8Ni:5Al) illustrating reprecipitation of β NiAl.

FIG. 1 is a schematic illustration of multi-scale cermet made using γ' $Ni_3(AlTi)$ strengthened binder phase (Ni (balance):15Cr:3Al:1Ti) and a transmission electron microscopy (TEM) image of binder phase illustrating reprecipitation of cuboidal γ' $Ni_3(AlTi)$. FIG. 2 is a schematic illustration of multi-scale cermet made using β NiAl strengthened binder phase (Fe(balance):18Cr:8Ni:5Al) illustrating reprecipitation of β NiAl.

Yet another component of the multi-scale cermet represented by the formula (PQ)(RS)X where X is the derivative compound G derived from the ceramic phase (PQ) with or without the co-participation of the binder phase elements (RS). For example, G can be represented by $P_aR_bS_cQ_d$ where P, Q, R and S are described earlier and a, b, c, d are whole or fractional numbers in the range of 0 to 30. As a non-limiting illustrative example when P is a Group VI element Cr; Q is carbide; b and c are zero, G can be $Cr_{23}C_6$, $Cr_7C_3$, $Cr_3C_2$. One feature of the derivative compound G is that they are dispersed in the binder phase (RS) as particles having a diameter between about 1 nm and about 400 nm, preferably between about 1 nm and about 200 nm and more preferably between about 1 nm and about 100 nm. In the multi-scale cermet composition, G ranges from of about 0.01 to 10 vol % based on the volume of the multi-scale cermet. The total volume percent of X in (PQ)(RS)X is about 0.01 to 10 vol % based on the volume of the cermet.

Therefore there exits in the multi-scale cermet composition a continuous binder phase (RS) and at least two dispersed phases: the ceramic (PQ) and at least one of an oxide dispersoid E, an intermetallic compound F and a derivative compound G such that the dispersed ceramic phase (PQ) is in the range of about 0.5 to 3000 microns diameter and the dispersed E, F and G components are in the range of about 1 nm to 400 nm diameter. Such a distribution of dispersed particles, one set of which (E, F, G) comprise the finer scale particle range and the other set of which (PQ) comprise the coarser scale particle range represents the multi-scale cermet of the present invention. The dispersed phases (PQ), E, F and G in the binder phase (RS) can exist in aggregated forms. Non-limiting examples of aggregated forms include doublets, triplets, quadruplets and higher number multiplets.

The volume percent of cermet phase (and cermet components) excludes pore volume due to porosity. The cermet can be characterized by a porosity in the range of 0.1 to 15 vol %. Preferably, the volume of porosity is 0.1 to less than 10% of the volume of the cermet. The pores comprising the porosity is preferably connected but not distributed in the cermet body as discrete pores. The mean pore size is preferably the same or less than the mean particle size of the ceramic phase (PQ).

In the cermets of the instant invention, the binder phase is designed not only for its crack blunting ability but also as an erosion resistant phase in its own right to provide step-out erosion resistant cermets. One consideration in improving the erosion resistance of binder phase is to increase flow stress at the service temperatures through dispersion strengthening by E, F, G constituents individually or in combination.

The cermet compositions of the instant invention possess enhanced erosion and corrosion properties. The erosion rates were determined by the Hot Erosion and Attrition Test (HEAT) as described in the examples section of the disclosure. The erosion rate of the multi-scale cermets of the instant invention is less than $1.0\times10^{-6}$ cc/gm of SiC erodant. The corrosion rates were determined by thermogravimetric (TGA) analyses as described in the examples section of the disclosure. The corrosion rate of the multi-scale cermets of the instant invention is less than $1\times10^{-10}$ $g^2/cm^4\cdot s$ or an average oxide scale of less than 150 μm thickness, preferably less than 30 μm thickness when subject to 100 cc/min air at 800° C. for at least 65 hours.

Preferably the cermet possesses fracture toughness of greater than about 3 $MPa\cdot m^{1/2}$, preferably greater than about 5 $MPa\cdot m^{1/2}$, and most preferably greater than about 10 $MPa\cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. The (RS) phase of the cermet of the instant invention as described in the earlier paragraphs is primarily responsible for imparting this attribute.

The cermet compositions are made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The resulting green body is then sintered at temperatures above about 1200° C. up to about 1750° C. for times ranging from about 10 minutes to about 4 hours. The sintering operation is preferably performed in an inert atmosphere or a reducing atmosphere or under vacuum. For example, the inert atmosphere can be argon and the reducing environment can be hydrogen. Thereafter the sintered body is allowed to cool, typically to ambient conditions. The cermet prepared according to the process of the invention allows fabrication of bulk cermet materials exceeding 5 mm in thickness.

One feature of the cermets of the invention is their microstructural stability, even at elevated temperatures, making them particularly suitable for use in protecting metal surfaces against erosion at temperatures in the range of about 300° C. to about 850° C. It is believed this stability will permit their use for time periods greater than 2 years, for example for about 2 years to about 10 years. In contrast many known cermets undergo transformations at elevated temperatures which results in the formation of phases which have a deleterious effect on the properties of the cermet.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, slide valve gates and guides, catalyst regenerators, and the like. Thus, metal surfaces exposed to erosive or corrosive environments, especially at about 300° C. to about 850° C. are protected by providing the surface with a layer of the cermet compositions of the invention. The cermets of the instant invention can be affixed to metal surfaces by mechanical means or by welding.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analysis.

The following non-limiting examples are included to further illustrate the invention.

Example 1

$TiB_2$ Cermet

A cermet without Y/Al oxide dispersoid based on 80 vol % of 14.0 μm average diameter of $TiB_2$ powder (99.5% purity, from Alfa Aesar, 99% screened below −325 mesh) and 20 vol % of Fe-26Cr alloy powder (99.5% purity, 74Fe:26Cr in wt %, from Alfa Aesar, screened between −150 mesh and +325 mesh) was prepared. Both $TiB_2$ powder and Fe-26Cr alloy powder were dispersed with ethanol in HDPE milling jar. The powders in ethanol were mixed for 24 hours with Yttria Toughened Zirconia (YTZ) balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held for 30 min for residual solvent removal. The disc was then heated to 1700° C. at 15° C./min in argon and held at 1700° C. for 30 minutes. The temperature was then reduced to below 100° C. at −15° C./min.

The resultant cermet comprised:

i) 79 vol % $TiB_2$ with average grain size of 7 μm ii) 7 vol % $M_2B$ with average grain size of 2 μm, where M=56Cr:41Fe:3Ti in wt % iii) 14 vol % Cr-depleted alloy binder (82Fe:16Cr:2Ti in wt %).

Example 2

$TiB_2$ Multiscale Cermet

A cermet with Y/Al oxide dispersoid based on 80 vol % of 14.0 μm average diameter of $TiB_2$ powder (99.5% purity, from Alfa Aesar, 99% screened below −325 mesh) and 20 vol % of 6.7 μm average diameter FeCrAlY alloy powder (Osprey Metals, Fe(balance):19.9Cr:5.3Al:0.64Y, 95.1% screened below −16 μm) was prepared. After processing the powder as described in Example 1, the cermet disc was then heated to 1500° C. at 15° C./min in argon and held at 1500° C. for 2 hours. The temperature was then reduced to below 100° C. at −15° C./min.

The resultant cermet comprised:

i) 79 vol % $TiB_2$ with average grain size of 7 μm ii) 4 vol % $M_2B$ with average grain size of 2 μm, where M=53Cr:45Fe:2Ti in wt % iii) 1 vol % Y/Al oxide dispersoid with a size ranging 5-80 nm iv) 16 vol % Cr-depleted alloy binder (78Fe:17Cr:3Al:2Ti in wt %).

Figure 3A:
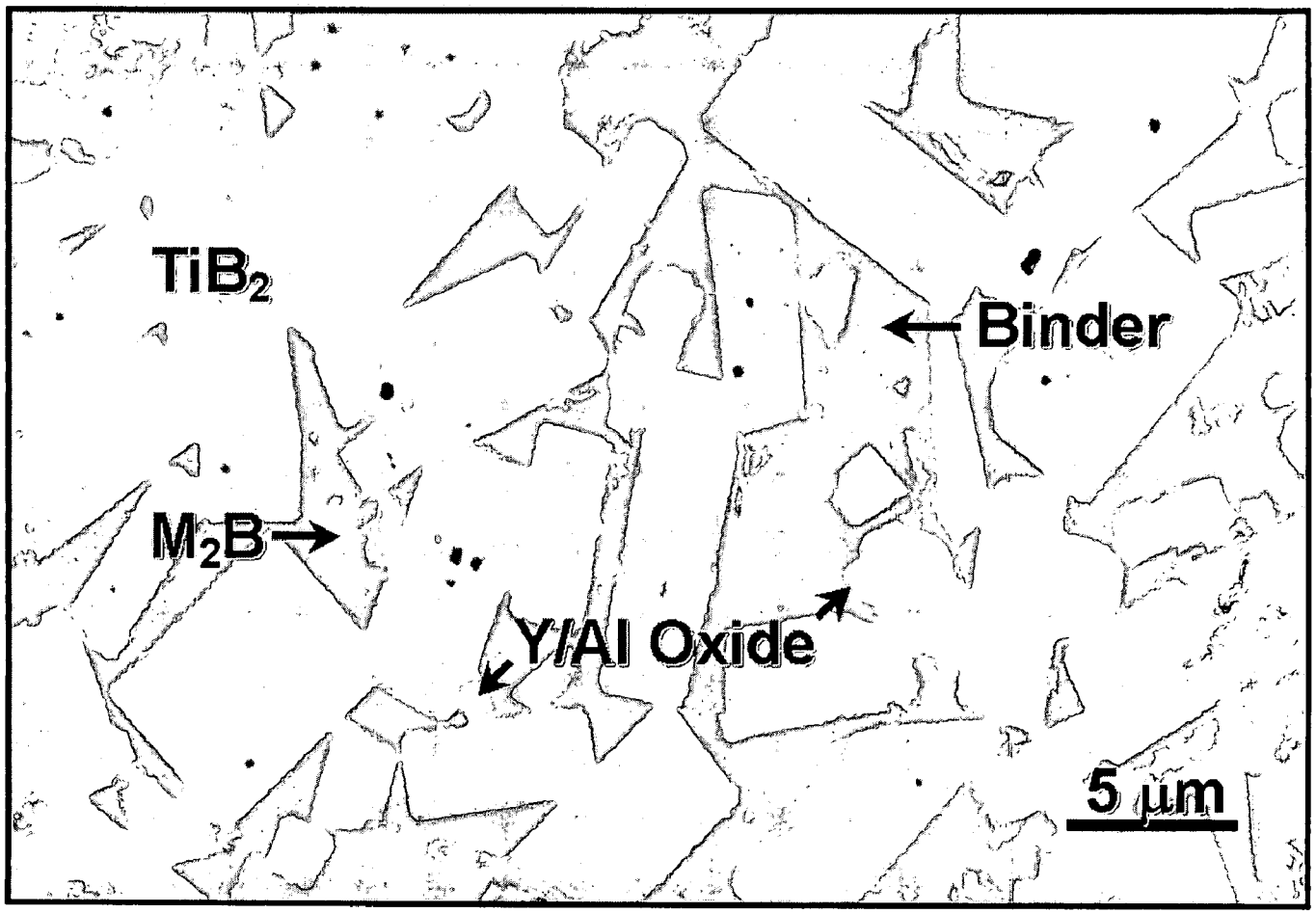
FIG. 3*a* is a SEM image of a $TiB_2$ cermet made using 20 vol % FeCrAlY alloy binder showing Y/Al oxide dispersoids and FIG. 3*b* TEM image of the same selected binder area as shown in FIG. 3*a*.
Figure 3B:
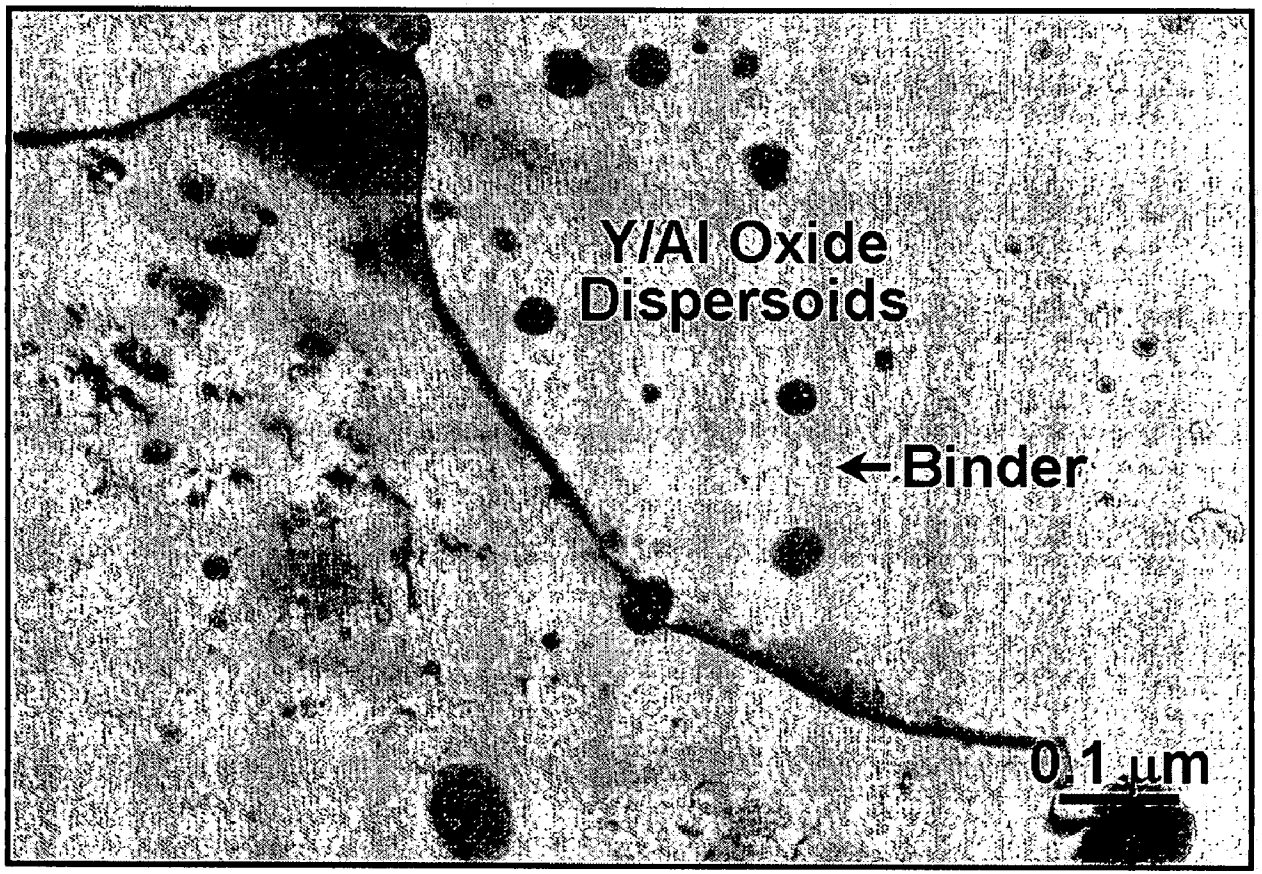

FIG. 3*a* is a SEM image of $TiB_2$ cermet processed according to Example 2, wherein the scale bar represents 5 μm. In this image the $TiB_2$ phase appears dark and the binder phase appears light. The Cr-rich $M_2B$ type boride phase and the Y/Al oxide phase are also shown in the binder phase. FIG. 3*b* is a TEM image of the selected binder area as in FIG. 3*a,* but wherein the scale bar represents 0.1 μm. In this image fine Y/Al oxide dispersoids with size ranging 5-80 nm are observed. These fine Y/Al oxide dispersoids appears dark and the binder phase appears light.

Example 3

Erosion Test

Each of the cermets of Examples 1 and 2 was subjected to a hot erosion and attrition test (HEAT). The procedure employed was as follows:

1) A specimen cermet disk of about 35 mm diameter and about 5 mm thick was weighed.

2) The center of one side of the disk was then subjected to 1200 g/min of SiC particles (220 grit, #1 Grade Black Silicon Carbide, UK abrasives, Northbrook, Ill.) entrained in heated air exiting from a tube with a 0.5 inch diameter ending at 1 inch from the target at an angle of 45°. The velocity of the SiC was 45.7 m/sec.

3) Step (2) was conducted for 7 hours at 732° C.

4) After 7 hours the specimen was allowed to cool to ambient temperature and weighed to determine the weight loss.

5) The erosion of a specimen of a commercially available castable refractory was determined and used as a Reference Standard. The Reference Standard erosion was given a value of 1 and the results for the cermet specimens are compared in Table 1 to the Reference Standard. In Table 1 any value greater than 1.0 represents an improvement over the Reference Standard. The erosion of a specimen with Y/Al oxide dispersoids of Example 2 showed superior HEAT results compared to that of a specimen without Y/Al oxide dispersoid of Example 1.

TABLE 1

| Cermet | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| $TiB_2$—20FeCr | 20.4712 | 20.1596 | 0.3116 | 5.11 | 5.04E+5 | 1.2099E−7 | 8.7 |
| $TiB_2$—20FeCrAlY | 14.9274 | 14.8027 | 0.1247 | 4.90 | 5.04E+5 | 5.0494E−8 | 17.4 |

Example 4

Corrosion Test

Each of the cermets of Examples 1 and 2 was subjected to an oxidation test. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hours at 800° C.

4) After 65 hours the specimen was allowed to cool to ambient temperature.

5) Thickness of oxide scale was determined by cross sectional microscopy examination of the corrosion surface.

6) In Table 2 any value less than 150 μm, preferably less than 30 μm represents acceptable corrosion resistance.

TABLE 2

| Cermet | Thickness of Oxide Scale (μm) |
|---|---|
| $TiB_2$—20FeCr | 18.0 |
| $TiB_2$—20FeCrAlY | 15.0 |

What is claimed is:

1. A cermet composition represented by the formula (PQ)(RS)X comprising: a ceramic phase (PQ), a binder phase (RS) wherein the binder phase (RS) comprises a base metal R selected from the group consisting of Fe, Ni, Co, Mn and mixtures thereof and an alloying metal S comprising Cr, and X wherein X is at least one member selected from the group consisting of an oxide dispersoid E, an intermetallic compound F and a derivative compound G wherein said ceramic phase (PQ) is dispersed in the binder phase (RS) as particles of diameter in the range of about 0.5 to 3000 microns, and said X is dispersed in the binder phase (RS) as particles in the size range of about 1 nm to 400 nm, and wherein the ceramic phase (PQ) ranges from about 55 to 95 vol % based on the volume of the cermet.

2. The cermet composition of claim 1 wherein the ceramic phase (PQ) comprises a metal P selected from the group consisting of Al, Si, Mg, Group IV, Group V, Group VI elements and mixtures thereof and Q, which is selected from the group consisting of carbide, nitride, boride, carbonitride, oxide and mixtures thereof.

3. The cermet composition of claim 2 wherein the ceramic phase (PQ) the molar ratio of P to Q can vary in the range of 0.5:1 to 30:1.

4. The cermet composition of claim 1 wherein the binder phase (RS) is in the range of 4.5 to 45 vol % based on the volume of the cermet and the base metal R to alloying metal S mass ratio ranges from 50/50 to 90/10.

5. The cermet composition of claim 1 wherein the oxide dispersoids E is selected from the group consisting of oxides Al, Ti, Nb, Zr, Hf, V, Ta, Cr, Mo, W, Fe, Mn, Ni, Si, Y and mixtures thereof and ranges from of about 0.1 to 10 vol % based on the volume of the cermet.

6. The cermet composition of claim 1 having a fracture toughness greater than about 3 $MPa \cdot m^{1/2}$.

7. The cermet composition of claim 1 having an erosion rate less than about $1\times10^{-6}$ cc/gram of SiC erodant.

8. The cermet composition of claim 1 having corrosion rate less than about $1\times1^{-100}$ $g^2/cm^4 \cdot s$ or an average oxide scale of less than 150 μm thickness when subject to 100 cc/min air at 800° C. for at least 65 hours.

9. The cermet composition of claim 1 having an erosion rate less than about $1\times10^{31\ 6}$cc/gram of SiC erodant and a corrosion rate less than about $1\times10^{-10}$ $g^2/cm^4 \cdot s$ or an average oxide scale of less than 150 μm thickness when subject to 100 cc/min air at 800° C. for at least 65 hours.

10. A metal surface provided with a camel composition according to any one of the preceding claims wherein said metal surface is resistant to erosion at temperatures up to 850° C.

11. A metal surface provided with a cermet composition according to any one of claims 1-3, 4-5 or 6-9 wherein said metal surface is resistant to erosion at temperatures in the range of 300° C. to 850° C.

12. The metal surface provided with a cermet composition of claim 10 wherein said metal surface comprises the inner surface of a fluid-solids separation cyclone.

13. A bulk cernet material represented by the formula (PQ)(RS)X comprising: a ceramic phase (PQ), a binder phase (RS) wherein the binder phase (RS) comprises a base metal R selected from the group consisting of Fe, Ni, Co, Mn and mixtures thereof and an alloying metal S comprising Cr, and X wherein X is at least one member selected from the group consisting of an oxide dispersoid E, an intermetallic compound F and a derivative compound C wherein said ceramic phase (PQ) is dispersed in the binder phase (RS) as particles of diameter in the range of about 0.5 to 3000 microns, and said X is dispersed in the binder phase (RS) as particles in the size range of about 1 nm to 400 nm, wherein the overall thickness of the bulk cermet material is greater than 5 millimeters in thickness, and wherein the ceramic phase (PQ) ranges from about 55 to 95 vol % based on the volume of the cermet.

14. The bulk cermet material of claim 13 wherein the ceramic phase (PQ) comprises a metal P selected from the group consisting of Al, Si, Mg, Group IV, Group V. Group VI elements and mixtures thereof and Q, which is selected from the group consisting of carbide, nitride, boride, carbonitride, oxide and mixtures thereof,

15. The bulk cermet material of claim 14 wherein the ceramic phase (PQ) the molar ratio of P to Q can vary in the range of 0.5:1 to 30:1

16. The bulk cermet material of 13 wherein the binder phase (RS) is in the range of 4.5 to 45 vol % based on the volume of the cermet and the base metal R to alloying metal S mass ratio ranges from 50/50 to 90/10.

17. The bulk cermet material of claim 13 wherein the oxide dispersoids E is selected from the group consisting of oxides Al, Ti, Nb, Zr, Hf, V, Ta, Cr, Mo, W, Fe, Mn, Ni, Si, Y and mixtures thereof and ranges from of about 0.1 to 10 vol % based on the volume of the cermet.

18. The bulk cermet material of claim 13 having a fracture toughness greater than about 3 $MPa \cdot m^{1/2}$.

19. The bulk cermet material of claim 13 having an erosion rate less than about $1\times10^{-6}$ cc/gram of SiC erodant.

20. The bulk cermet material of claim 13 having corrosion rate less than about $1\times10^{-10}$ $g^2/cm^4 \cdot s$ or an average oxide scale of less than 150 μm thickness when subject to 100 cc/min air at 800° C. for at least 65 hours.

21. The bulk cermet material of claim 13 having an erosion rate less than about $1\times10^{-6}$ cc/gram of SiC erodant and a corrosion rate less than about $1\times10^{-10}$ $g^2/cm^4 \cdot s$ or an average oxide scale of less than 150 μm thickness when subject to 100 cc/mm air at 800° C. for at least 65 hours.

22. A metal surface provided with a bulk cermet material according to any one of claims 13-15 or 16-21 wherein said metal surface is resistant to erosion at temperatures up to 850° C.

23. A metal surface provided with a bulk cermet material according to any one of claims 13-15 or 16-21 wherein said metal surface is resistant to erosion at temperatures in the range of 300° C. to 850° C.

24. The metal surface provided with a bulk cermet material of claim 22 wherein said metal surface comprises the inner surface of a fluid-solids separation cyclone.

25. The cermet composition of claim 1 wherein the alloying metal S further comprises at least one or more alloying member chosen from Si, Ti, Al, Nb, and Mo.

26. The bulk cermet material of claim 13 wherein the alloying metal S further comprises at least one or more alloying member chosen from Si, Ti, Al, Nb, and Mo.

* * * * *